United States Patent [19]

Lieb

[11] 4,421,432

[45] Dec. 20, 1983

[54] KEY SWITCH CAP MOUNTING ARRANGEMENT

[75] Inventor: M. Jeremy Lieb, Freeport, Ill.

[73] Assignee: Honeywell Inc., Minneapolis, Minn.

[21] Appl. No.: 299,356

[22] Filed: Sep. 4, 1981

[51] Int. Cl.[3] ..... B41J 5/12

[52] U.S. Cl. ..... 400/492; 400/495; 400/496

[58] Field of Search ..... 400/492, 495, 490, 496; 403/4; 200/159 R; 178/110

[56] References Cited

U.S. PATENT DOCUMENTS

| | | | |
|---|---|---|---|
| 2,425,808 | 8/1947 | Jakosky | 403/4 |
| 3,203,285 | 8/1965 | Schmidt | 403/4 |
| 3,248,034 | 4/1966 | McNutt | 403/4 |
| 3,667,787 | 6/1972 | Semour | 400/492 X |
| 4,294,555 | 10/1981 | Galaske et al. | 400/495 X |
| 4,349,286 | 9/1982 | Blaser et al. | 400/492 |

FOREIGN PATENT DOCUMENTS 129499 1/1978 German Democratic Rep. .... 403/4

OTHER PUBLICATIONS

IBM Technical Disclosure Bulletin, vol. 13, No. 7, Dec. 1970, p. 1756 "Two Piece Actuator Button" G. L. Jarvis.

*Primary Examiner*—William Pieprz
*Attorney, Agent, or Firm*—Charles L. Rubow

[57] ABSTRACT

A key switch cap mounting arrangement for use on a keyboard is disclosed in which the key cap and a column on which it is supported are formed with a cylindrical post and mating socket aligned with axes angularly offset from an axis perpendicular to the upper surface of the key cap and the longitudinal axis of the column. The cap and column can be assembled either so that the surface of the key cap is perpendicular to the axis of the column to provide for a sloped keyboard, or so that the surface of the cap is tilted from its perpendicular position to provide for a stepped keyboard.

13 Claims, 12 Drawing Figures

KEY SWITCH CAP MOUNTING ARRANGEMENT

BACKGROUND OF THE INVENTION

The invention disclosed herein relates generally to arrangements for mounting key caps in key switch apparatus, and more particularly to a key cap and support column configuration which permits mounting of the cap in either of two angular relationships relative to the column to provide for either a sloped or a stepped keyboard configuration using the same parts.

Manual keyboards, such as used in office machines, computer terminals and other manually controlled electronic installations are commonly produced in either sloped or stepped configurations. In either configuration, an array of key switches is mounted on a panel which is inclined relative to horizontal. In the sloped configuration, the top surfaces of the key caps are generally parallel with the supporting panel and define a plane parallel therewith. In the stepped configuration, the plane defined by the top surface of each key cap is at an angle with respect to the supporting panel. The angle may be equal and opposite to the angle of inclination of the panel so that the key tops are horizontal, and the rows of key tops are in tiers or steps.

The selection of a keyboard configuration depends both on application requirements and predominant operator preference. However, aside from the particular geometry, the keyboards and switches used therein contain the same basic functional elements. Manufacturers of key switches and keyboards must normally be able to supply parts and assemblies for either keyboard configuration. Of course, this can be accomplished by utilizing different sets of key caps and associated plungers or columns for each configuration. However, such an approach requires duplication of inventory and manufacturing effort.

One technique utilized to avoid such duplication has been to provide key caps and associated support columns with two sets of mating surfaces so that the caps and columns can be assembled in either of two angular relationships. U.S. Pat. No. 3,667,787 issued to N. Semour on June 6, 1972 shows such an arrangement. As disclosed in the patent, the key cap contains a recess having one set of surfaces which is perpendicular to the upper surface of the cap and a second set of surfaces which is inclined with respect to surfaces in the first set by an angle equal to a desired key top angle. The support column or post is formed with complimentary mating surfaces, some of which are parallel with a longitudinal axis of the post and some of which are inclined with respect to the longitudinal axis.

At least some of the mating surfaces are paired in different ways to establish the two different angular relationships. Assembly in one relationship predominantly utilizes parallel exterior surfaces on the post and complimentary interior surfaces in the cap. Assembly in the other relationship in which the post and cap are rotated 180° relative to one another utilizes surfaces in planes inclined toward one another on the post and corresponding inclined surfaces in the cap. Where parallel surfaces are used, a secure friction fit between the cap and post can be easily achieved. This relationship minimizes any tendency for the cap to "walk off" the post with use.

The previously described arrangement requires a somewhat complex geometry for the recess in the key cap and mating areas on the top of the support post. If the elements are molded from a thermosetting plastic or other similar material, manufacturing of the molds and the subsequent molding process are correspondingly complicated. More complicated forms generally dictate maintenance of closer tolerance control, and result in poor tolerance control having greater effect on fit. Another characteristic of having two at least partially independent sets of mating surfaces is that not all of the surfaces can be in contact so as to be load bearing in alternative configurations. In general, it is preferable to maximize the load bearing area so as to minimize stresses in the material.

The applicant has provided a unique key cap mounting arrangement adapted for either of two angular orientations in which the same set of parallel mating surfaces on the key cap and corresponding surfaces on the support column are used for either orientation. Since the mating surfaces are parallel for both orientations, there is no tendency for the cap to "walk off" the column with use. The form required for the mating surfaces is exceptionally simple, thus minimizing the complexity of forming molds and the molding process, and minimizing sensitivity to dimensional tolerances.

SUMMARY OF THE INVENTION

The present invention is a key switch cap mounting arrangement which provides for assembly of a key cap and support column in either of two angular relationships, and a keyboard utilizing the features of such a cap mounting arrangement. The key cap is provided with a downwardly projecting post or socket aligned with an axis of symmetry which forms a predetermined acute angle with an axis perpendicular to an outer surface of the cap. The column is formed with a mating socket or post on its upper end configured to snugly mate with the post or socket on the key cap. The socket or post on the column is aligned with an axis of symmetry which also forms the predetermined acute angle with a longitudinal axis of the column. Thus, the column and cap can be assembled either so that the outer surface of the cap is perpendicular to the longitudinal axis of the column or, by rotating the column 180° about its longitudinal axis relative to the cap, so that the surface of the cap is inclined by an angle equal to twice the predetermined acute angle from a position perpendicular to the longitudinal axis. The socket may be formed with an enlarged cross-section at a depth less than the length of the post and the post formed of a plastic material whereby the end thereof expands slightly in the enlarged cross-section to enhance secure mounting of the cap to the column. Finally, in order to provide a firm seat between the column and the cap for either angular relationship, the end of the column and inner surface of the cap may be configured with plane or step surfaces perpendicular to the axes of symmetry of the socket and post.

DESCRIPTION OF THE PREFERRED EMBODIMENT

Figure 1:
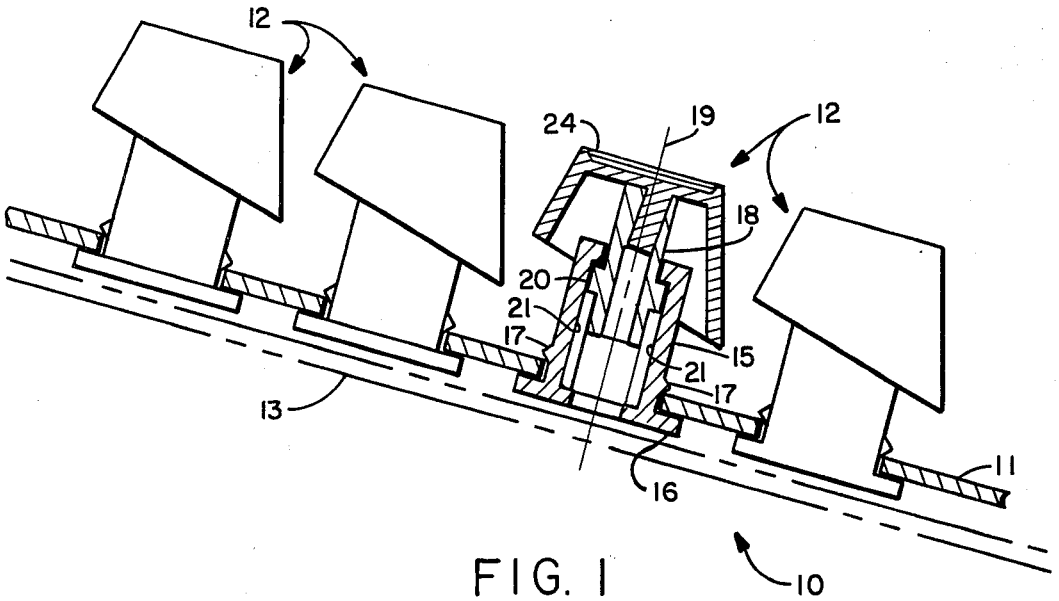
FIG. 1 is a sectional view of a keyboard in which key caps and support columns in accordance with the applicant's invention are assembled to provide a sloped keyboard configuration.
Figure 2:
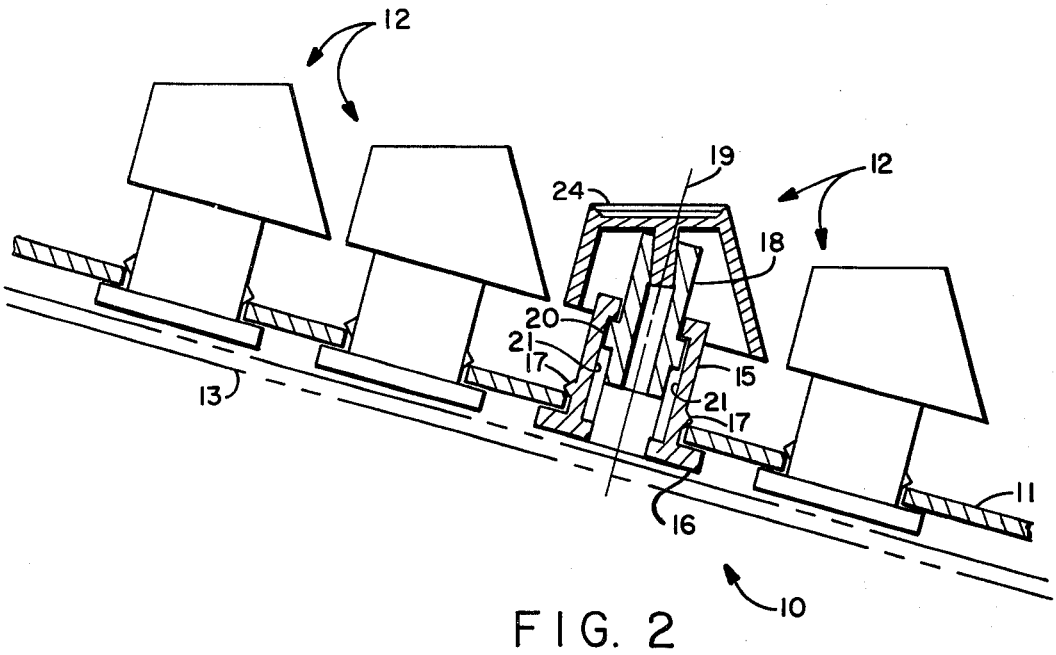
FIG. 2 is a sectional view of a keyboard in which key caps and support columns in accordance with the applicant's invention are assembled to provide a keyboard having a stepped configuration.

In FIGS. 1 and 2, reference numeral 10 generally identifies a manual keyboard, such as is typically used in office machines, computer terminals and other manually controlled electronic installations. Keyboard 10 comprises a supporting panel 11 which supports an array of key switches each comprising an actuator generally identified by reference numeral 12 and an electrical switching element. The switching elements are illustrated as outline form 13 in FIGS. 1 and 2, and may comprise variable capacitors in an array of such capacitors. A variable capacitor array suitable for use in keyboard 10 is the subject of U.S. Pat. No. 4,359,720 entitled "Environmentally Sealed Variable Capacitance Apparatus", issued Nov. 16, 1982 in the name of T. Y. Chai et al and assigned to the same assignee as the present application.

As shown in section in FIGS. 1 and 2, each actuator basically comprises a housing 15 which is mounted through an aperture in panel 11. Housing 15 is held in place by a flange 16 on the housing which is drawn against the lower side of panel 11 by a plurality of resilient projections 17 on the housing above the panel. A plunger or support column 18 which extends along a longitudinal axis 19 is slideably mounted in housing 15 for movement along axis 19. Column 18 is prevented from rotating or sliding out of housing 15 by tabs 20 on the column which slide in channels 21 in the housing. A spring (not shown) biases plunger 18 in an upward direction.

The upper end of column 18 is fitted with a key cap 24 to facilitate manual actuation. When actuated, the lower end of column 18 slightly depresses an area on the surface of capacitor array 13, thus changing the capacitance of a particular capacitor and providing an output signal as described in the above identified patent.

The keyboard shown in FIG. 1 has a sloped configuration in which the key caps and support columns are assembled so that the upper surfaces of the key caps generally lie in a common plane parallel with panel 11 and perpendicular to the longitudinal axes of the support columns. FIG. 2 illustrates the same components as shown in FIG. 1 assembled such that the upper surfaces of key caps 24 are inclined relative to the position shown in FIG. 1. Specifically the upper surfaces of the key caps in the keyboard of FIG. 2 are terraced or stepped up the keyboard. Accordingly, the same parts can be used to produce either a sloped or a stepped keyboard in accordance with the requirements of a particular application or predominant operator preference.

The key cap and column geometry which permits assembly in either angular relationship will be discussed in greater detail hereinafter. For purposes of the present description, however, it is pointed out that, although longitudinal axes 19 as shown in the cross-sections of FIGS. 1 and 2 are at right angles to panel 11, they could be at any suitable angle. In any case, the longitudinal axes for the switch actuators shown, and for other actuators in other cross-sections parallel with the cross-sections of FIGS. 1 and 2, form predetermined angles with the panel.

Figure 3:
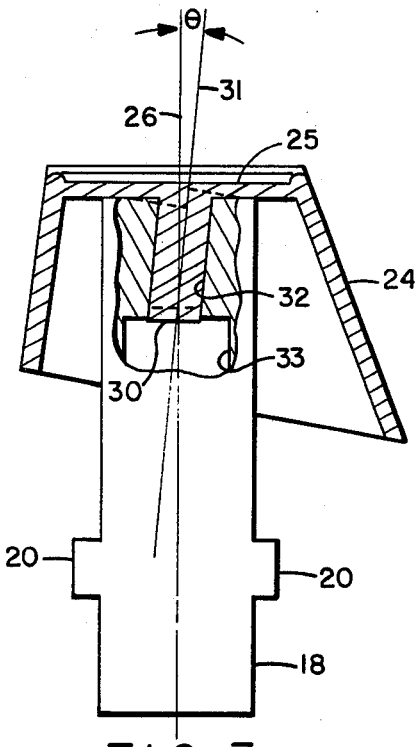
FIG. 3 is an enlarged view, partly in section, of a first embodiment of a key cap and support column assembled for the keyboard of FIG. 1.
Figure 4:
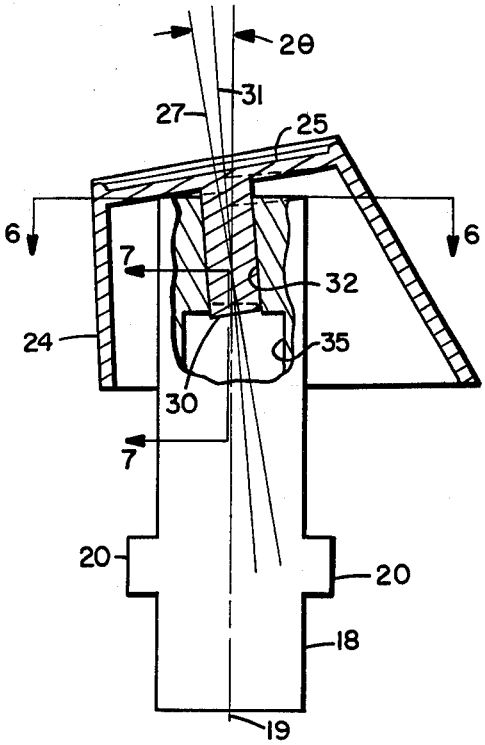
FIG. 4 is an enlarged view, partially in section, of the first embodiment of a key cap and column assembled for the keyboard of FIG. 2.
Figure 5:
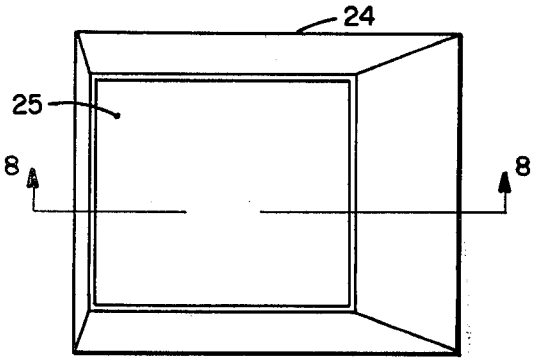
FIG. 5 is a top view of the key cap shown in FIGS. 3 and 4.

In FIGS. 3 and 4, various features of the key cap and column are identified by the same reference numerals as applied to those features in FIGS. 1 and 2. Cap 24 includes an outer surface 25, also shown in FIG. 5, which is adapted for operator contact. Surface 25 is contoured for operator comfort and efficiency, and thus is not actually planar. However, at least the periphery of surface 25 generally lies in a plane, and for purposes of this description is considered as defining a plane.

In FIG. 3, column 18 and cap 24 are assembled as required to produce the sloped keyboard of FIG. 1. Line 26 coincides with longitudinal axis 19 of column 18. Line 26 also coincides with an axis which is perpendicular to the plane defined by surface 25 of cap 24. This axis is better shown in FIG. 4 where it is identified by reference numeral 27.

In the embodiment of FIGS. 3 and 4 an inner surface of cap 24 is formed with a cylindrical post 30 which is aligned with and symmetrical about an axis which coincides with line 31. This axis forms an acute angle $\theta$ with axis 27 (coincident with line 26 in FIG. 3). For purposes of describing and claiming the present invention, a cylinder is defined as any surface traced by a straight line moving parallel to a fixed straight line. Thus, cylindrical refers to any shape which has a constant cross section along a fixed axis.

Post 30 is snugly received in a cylindrical socket or opening 32 in an end of column 18. Socket 32 extends along an axis which also coincides with line 31. Thus, the axis of socket 32 forms an acute angle $\theta$ with longitudinal axis 19 of column 18. As shown in FIG. 3 the angular orientations of post 30 and socket 32 are mutually offsetting, and surface 25 is perpendicular to the longitudinal axis of column 18.

FIG. 4 shows column 18 and cap 24 assembled as required to produce the stepped keyboard of FIG. 2. Column 18 is rotated 180° about axis 19 from its position in FIG. 3. Accordingly, axis 27 is at angle $\theta$ in a counter clockwise direction from the axis of post 30 and socket 32. Since the axis of post 30 and socket 32 is also at angle $\theta$ in a counter clockwise direction from longitudinal axis 19, axis 27 is at an angle of $2\theta$ from axis 19. Accordingly, surface 25 is inclined from the position shown in FIG. 3 by an angle of $2\theta$.

Figure 6:
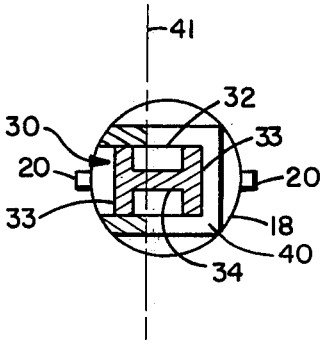
FIG. 6 is a partial sectional view of the assembled key cap and support column of FIG. 4 taken along line 6—6.

As shown in FIG. 6, socket 32 preferably has a rectangular cross-section. Post 30 is shown as having an I-shaped cross-section in which the I-shape defines a rectangular envelope identical to the rectangular cross-section of socket 32. The I-shape comprises a pair of substantially identical parallel flanges 33 separated by a web 34. The outer surfaces of flanges 33 mate with principal surfaces at least partially bounding socket 32. The principal surfaces are planar and parallel in the embodiment illustrated in FIG. 6. However, other shapes of principal surfaces may be used provided they are symmetrical with respect to the axis of the socket. Accordingly, post 30 may be inserted into socket 32 in either of the two orientations required for the angular relationships illustrated in FIGS. 3 and 4. Specifically, post 30 can be inserted into socket 32 at any integral multiple of 180° relative rotation between column 18 and cap 24 about the axes of the post and socket.

From FIGS. 3 and 4, it can be observed that the same set of parallel mating surfaces on post 30 and in socket 32 are utilized for both angular relationships of column 18 and cap 24. Both angular orientations result in contact over substantially the same areas between the mating surfaces of the post and socket.

Figure 7:
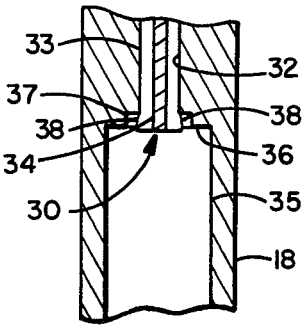
FIG. 7 is a partial sectional view of the assembled key cap and support column of FIG. 4 taken along line 7—7.

Since the surfaces on post 30 which mate with socket 32 are parallel, there is no tendency for the post to "walk out" of the socket with use. Secure mounting of the cap to the column is further assured by an additional feature of the applicant's design. As illustrated in FIGS. 3, 4, and 7 socket 32 has a uniform cross-section for a depth somewhat less than the length of post 30. At a greater depth, identified by reference numeral 35, the cross-section of the socket is enlarged.

In an embodiment actually fabricated, column 18 was formed with a bore extending longitudinally through the column. The portion of the bore remote from cap 24 was basically circular in cross-section. A shoulder 36 formed the transition between the portions of the bore having circular and rectangular cross-sections. On sides of the bore adjacent flanges 33 a single step transistion was made between the portions of the bore. On alternate sides of the bore the transistion was made in two steps as shown at 37 in FIG. 7.

Column 18 and cap 24 may be formed of a plastic material, and post 30 and socket 32 sized for a snug fit. After the post is inserted into the socket the ends of flanges 33 which extend into the enlarged portion of the bore tend to cold flow to form a slightly expanded end on the post as shown in exaggerated form at 38. The slightly expanded end further secures cap 24 to column 18.

Figure 8:
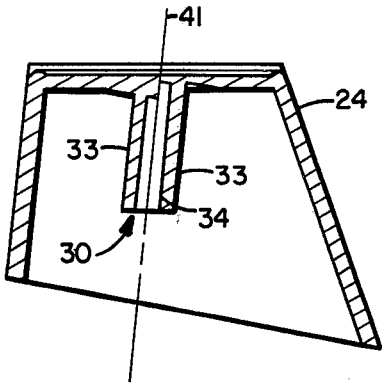
FIG. 8 is an enlarged sectional view of the key cap of FIG. 5 taken along line 8—8.

In the embodiment of FIGS. 3–7 an area 40 on the end of column 18 surrounding socket 32 (see FIG. 6) and a corresponding area on the inner surface of cap 24 surrounding post 30 (see FIG. 8) are shown with stepped abutting surfaces formed for firm seating in either angular relationship between the cap and the column. This is accomplished by forming the areas as complimentary steps perpendicular to the axes of post 30 and socket 32. The rise between the steps occurs at a center plane whose edge corresponds to line 31 in FIGS. 3 and 4, and is further identified by reference numeral 41 in FIGS. 6 and 8.

With column 18 and cap 24 assembled in the angular relationship shown in FIG. 3, both steps on the column are in full contact with both steps on the cap. With the column and cap assembled in the angular relationship shown in FIG. 4, one step on the column is in full contact with the other step on the cap from the one with which it was in contact in the arrangement of FIG. 3. In either case the contacting steps are parallel, and point or line contact between steps is avoided.

Figure 9:
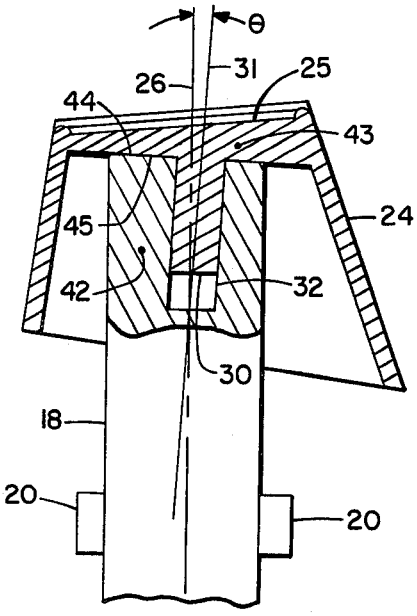
FIG. 9 is an enlarged schematic view, partially in section, of a second embodiment of a key cap and support column assembled for a sloped keyboard.
Figure 10:
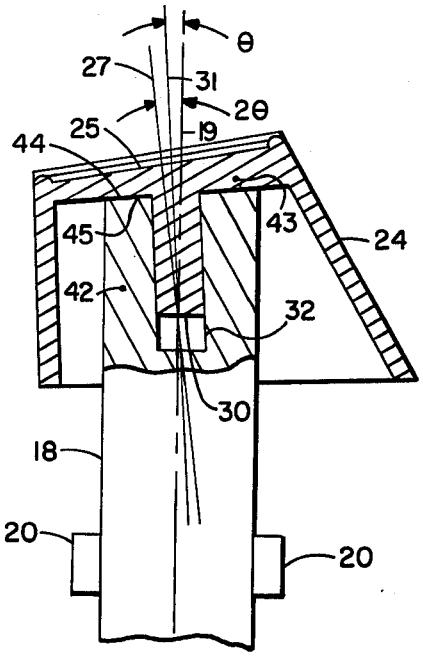
FIG. 10 is an enlarged schematic view, partially in section, of the second embodiment of a key cap and support column assembled for a stepped keyboard.

FIGS. 9 and 10 illustrate an embodiment of the applicant's invention in which there is full contact between the top of the column and a corresponding portion of a lower surface on the key cap for both angular relationships between the column and key cap. The features shown in FIGS. 9 and 10 are identified by the same reference numerals as corresponding features in the preceding Figures. For descriptive purposes, column 18 is considered to include a portion or element 42 which has socket 32 therein, and key cap 24 is considered to include a portion or element 43 which has post 30 thereon. End surface 44 of element 42 is planar and perpendicular to the axis of symmetry (coincident with line 31) of socket 32. Likewise, the portion 45 of the inner surface of element 43 which bears on end surface 44 is perpendicular to the axis of symmetry (also coincident with line 31) of post 30. Since the axes of symmetry of post 30 and socket 32 coincide for both angular relationships of column 18 and key cap 24, surfaces 44 and 45 are in full contact in either angular relationship.

Figure 11:
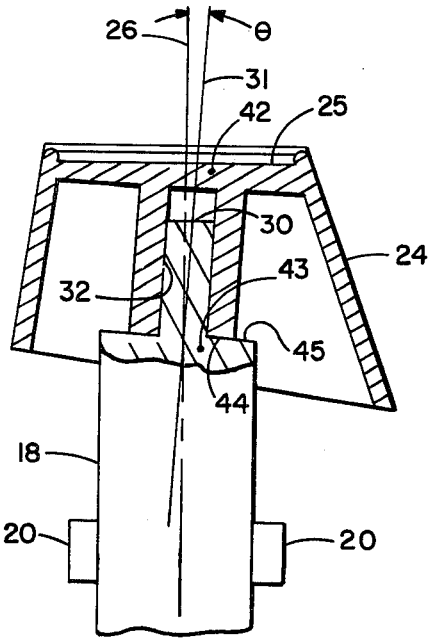
FIG. 11 is an enlarged schematic view, partially in section, of a third embodiment of a key cap and column assembled for a sloped keyboard.
Figure 12:
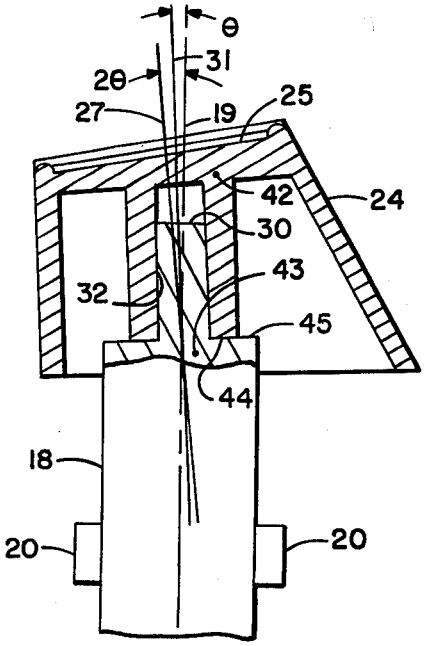
FIG. 12 is an enlarged schematic view, partially in section of the third embodiment of a key cap and column assembled for a stepped keyboard.

FIGS. 11 and 12 illustrate another embodiment of the applicant's invention having all the features (identified by the same reference numerals) of the embodiment of FIGS. 9 and 10, but with elements 42 and 43 interchanged. Thus, element 42 with socket 32 therein is a part of key cap 24 and element 43 with post 30 thereon is a part of column 18. As in the embodiment of FIGS. 9 and 10, surfaces 44 and 45 are perpendicular to the axes of symmetry of post 30 and socket 32, and are in firm contact for both angular relationships of column 18 and key cap 24.

In accordance with the foregoing description, the applicant has provided a unique key switch cap mounting arrangement in which the same parts can be assembled in two different ways to produce either a sloped or a stepped keyboard. The unique geometry of the parts results in contact of parallel mating surfaces for either keyboard configuration. Hence, mounting is secure, and the surface geometry of the parts is simple and provides maximum contact between surfaces on mating parts.

Although several particular embodiments have been shown and described for illustrative purposes, a number of variations and modifications will be apparent to those familiar with the relevant arts. It is intended that coverage of the invention not be limited to the embodiment shown, but only by the terms of the following claims.

The embodiments of the invention in which an exclusive property or right is claimed are defined as follows:

1. Key switch actuator apparatus having a key cap mountable in either of two angular relationships relative to a supporting column comprising:

a column having an end with a cylindrical socket therein aligned with a first axis which forms a predetermined acute angle with a second longitudinal axis of said column;

a key cap having an outer surface adapted for operator contact, said outer surface generally defining a plane; and a cylindrical post on an inner surface of said key cap configured to be snugly received in the socket and aligned with a third axis which forms an acute angle substantially equal to the predetermined acute angle with a fourth axis perpendicular to the plane defined by the outer surface of said cap, whereby said column and said key cap can be assembled in a first angular relationship in which the first and second axes coincide with the third and fourth axes respectively so that the plane defined by the outer surface of said cap is substantially perpendicular to the longitudinal axis of said column, or in a second angular relationship in which said column and said key cap are rotated 180° relative to one another about the first and third axes so that the plane defined by the outer surface of said key cap is inclined from its first angular relationship by an angle equal to twice the predetermined acute angle.

2. The apparatus of claim 1 wherein:

the socket in the end of said column is rectangular in cross-section; and said post defines a rectangular envelope having a cross-section substantially identical to that of the socket.

3. The apparatus of claim 2 wherein said post has a I-shaped cross-sectional configuration.

4. The apparatus of claim 1, 2, or 3 wherein:

the socket includes a first portion adjacent the end of said column having a uniform cross-section throughout a distance less than the length of said post, and a second portion further from the end said column having a cross-section larger than the cross-section of the first portion; and said post is formed of a plastic material, whereby when said key cap is mounted on said column the end of said post remote from said key cap extends beyond the first portion of the socket where it tends to expand to secure said key cap to said column.

5. An arrangement for mounting a key cap on a column in either of two angular relationships comprising:

a column having an end in which is located a cylindrical opening symmetrical about a first axis which forms a predetermined acute angle with a second longitudinal axis of said column, the first and second axes defining a first plane; and a key cap having an outer surface thereon adapted for operator contact and defining a second plane, and an inner surface on which is formed a cylindrical post configured to be snugly received in the opening in the end of said column, the post extending along a third axis which forms an acute angle substantially equal to the predetermined acute angle with a fourth axis perpendicular to the second plane, whereby said key cap and said column can be assembled in either of first and second angular relationships in which the first and third axes coincide and the fourth axis lies in the first plane, the first angular relationship being characterized by coincidence of the second and fourth axes so that the second plane is perpendicular to said column, the second angular relationship being characterized by the second and fourth axes forming an angle twice the predetermined angle so that the second plane is tilted by an angle equal to twice the predetermined acute angle from perpendicular to said column.

6. The arrangement of claim 5 wherein the opening in the end of said column is rectangular in cross-section; and the post on said key cap defines a rectangular envelope having a cross-section substantially identical to that of the opening in the end of said column.

7. The arrangement of claim 5 or 6 wherein areas on the inner surface of said key cap surrounding the post and on the end of said column surrounding the opening each have an area perpendicular to the first and third axes.

8. A keyboard adapted for either a sloped or a stepped configuration comprising:

a support panel;

an array of key actuated switches mounted on said support panel, each switch including;

(a) a column having an end with a cylindrical socket therein aligned with a first axis which forms a first predetermined acute angle with a second longitudinal axis of said column, said switches being mounted so that the second axes form second predetermined angles with said support panel, said second predetermined angles lying in parallel first planes perpendicular to said support panel, (b) a key cap having an outer surface adapted for operator contact, said outer surface defining a second plane, and (c) a cylindrical post on an inner surface of the key cap configured to be snugly received in the socket and aligned with a third axis which forms an angle equal to the first angle with a fourth axis perpendicular to the second plane, whereby the switches can be mounted on the support panel with the columns and the key caps assembled in a first angular relationship in which the first and second axes coincide with the third and fourth axes respectively so that the angles formed between the fourth axes and said support panel are equal to the second angles, or in a second angular relationship in which each column and associated key cap are rotated 180° relative to one another about the first and third axes so that the fourth axes form third angles different from the second angles with said support panel.

9. The keyboard of claim 8 wherein said second predetermined angles are right angles.

10. An arrangement for mounting a key cap on a column in either of two angular relationships comprising:

a first element having a socket therein of substantially constant cross-section along a first axis and at least partially bounded by two principal surfaces which are symmetrical with respect to the first axis;

a second element having a post thereon of substantially constant cross-section along a second axis, the post defining an envelope substantially identical in cross-section to that of the socket in said first element;

a column having an end which forms one of said first and second elements, said column extending along a third axis which forms a first acute angle with the axis of said one of said first and second elements; and a key cap having an inner surface on which is formed the other of said first and second elements and an outer surface adapted for operator contact, the outer surface generally defining a plane perpendicular to a fourth axis which forms a second acute angle with the axis of said other of said first and second elements, the second acute angle being equal to the first acute angle, whereby said key cap and said column can be assembled by inserting the post into the socket in a first relationship so that the first and second angles coincide to provide a first key cap position in which the plane defined by the outer surface of said key cap is perpendicular to the third axis, or by inserting the post into the socket in a second relationship in which the first and second angles are adjacent to provide a second key cap position in which said key cap is inclined from its first position by an angle equal to the sum of the first and second angles.

11. The arrangement of claim 10 wherein said first element is formed on the end of said column and said second element is formed on the inner surface of said key cap.

12. The arrangement of claim 10 wherein the first element is formed on the inner surface of said key cap and the second element is formed on the end of said column.

13. The arrangement of claim 11 or 12 wherein the socket in said first element is rectangular in cross-section and the post on said second element defines a rectangular envelope substantially identical in cross-section to that of the socket.

* * * * *